US012570442B2

(12) United States Patent
Berge et al.

(10) Patent No.: US 12,570,442 B2
(45) Date of Patent: Mar. 10, 2026

(54) CLOSURE WITH PIVOTAL CAP

(71) Applicant: Silgan White Cap LLC, Downers Grove, IL (US)

(72) Inventors: Gary L. Berge, Crystal Lake, IL (US); Sungsuk Steve Kim, Batavia, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 18/658,277

(22) Filed: May 8, 2024

(65) Prior Publication Data

US 2024/0375830 A1 Nov. 14, 2024

Related U.S. Application Data

(60) Provisional application No. 63/501,056, filed on May 9, 2023.

(51) Int. Cl.
*B65D 47/08* (2006.01)

(52) U.S. Cl.
CPC ..... *B65D 47/0804* (2013.01)

(58) Field of Classification Search
CPC ..... B65D 41/34; B65D 47/00; B65D 47/04; B65D 47/06; B65D 47/08
See application file for complete search history.

(56) References Cited

U.S. PATENT DOCUMENTS

| | | | | |
|---|---|---|---|---|
| 2,601,040 | A | 6/1952 | Livingstone | |
| 3,009,610 | A | 11/1961 | Kubiliunas | |
| 3,168,221 | A | 2/1965 | Parker | |
| 4,550,862 | A | 11/1985 | Barker et al. | |
| 4,638,916 | A | 1/1987 | Beck et al. | |
| 4,795,044 | A | 1/1989 | Beck | |
| 4,801,054 | A | 1/1989 | Nycz | |
| 5,850,953 | A | 12/1998 | Dallas, Jr. | |
| 6,039,224 | A | 3/2000 | Dallas, Jr. et al. | |
| 6,116,477 | A * | 9/2000 | Kreiseder | B65D 47/0857 222/546 |
| 6,398,076 | B1 | 6/2002 | Giblin et al. | |
| 6,851,586 | B2 | 2/2005 | Odet | |
| 6,932,249 | B1 | 8/2005 | Pugne | |
| 7,048,158 | B2 | 5/2006 | Hierzer | |
| D530,202 | S | 10/2006 | Herald et al. | |
| D576,875 | S | 9/2008 | Steiger et al. | |

(Continued)

FOREIGN PATENT DOCUMENTS

| | | |
|---|---|---|
| GB | 2473042 | 3/2011 |
| JP | 2003-221053 | 8/2003 |

(Continued)

OTHER PUBLICATIONS

International Search Report and Written Opinion for International Application No. PCT/US2021/029674, dated Jul. 29, 2021, 10 pages.

*Primary Examiner* — Kareen K Thomas
(74) *Attorney, Agent, or Firm* — Reinhart Boerner Van Deuren s.c.

(57) ABSTRACT

A closure including a base that couples to a container neck of a container, and a cap that is pivotally coupled to the base. A projection is coupled to a front of a panel of the base panel and extends upwards and radially outward from the panel. The cap interfaces with the projection when pivoting from the closed position.

17 Claims, 7 Drawing Sheets

(56) References Cited

U.S. PATENT DOCUMENTS

| | | | | |
|---|---|---|---|---|
| D610,454 | S | 2/2010 | Lohrman et al. | |
| D612,729 | S | 3/2010 | Lohrman et al. | |
| 7,721,901 | B1 | 5/2010 | Von Spreckelsen et al. | |
| D626,410 | S | 11/2010 | Lohrman et al. | |
| D626,412 | S | 11/2010 | Lohrman et al. | |
| D626,413 | S | 11/2010 | Lohrman et al. | |
| D636,671 | S | 4/2011 | Lohrman et al. | |
| D636,672 | S | 4/2011 | Lohrman et al. | |
| D636,673 | S | 4/2011 | Lohrman et al. | |
| 7,931,163 | B2 | 4/2011 | Von Spreckelsen et al. | |
| 9,108,774 | B2 | 8/2015 | Kwon | |
| 9,187,219 | B2 * | 11/2015 | Brannon | B65D 47/40 |
| 9,272,824 | B2 | 3/2016 | Vogel et al. | |
| 9,415,909 | B2 * | 8/2016 | Druitt | B65D 47/0809 |
| 9,580,216 | B2 | 2/2017 | Wisniewski | |
| 10,654,624 | B2 | 5/2020 | Sung | |
| 10,829,274 | B2 * | 11/2020 | Pristera | B65D 41/3428 |
| 10,926,923 | B2 | 2/2021 | Berroa Garcia | |
| 2008/0000923 | A1 | 1/2008 | Berge | |
| 2008/0169261 | A1 * | 7/2008 | Druitt | B65D 47/0809 215/253 |
| 2010/0219186 | A1 | 9/2010 | Kuwagaki et al. | |
| 2011/0174760 | A1 | 7/2011 | Luzzato et al. | |
| 2012/0298666 | A1 | 11/2012 | Kwon | |
| 2019/0135504 | A1 * | 5/2019 | Koenigseder | B65D 47/08 |
| 2020/0239203 | A1 * | 7/2020 | Rognard | B65D 47/08 |
| 2021/0016941 | A1 * | 1/2021 | Wohlgenannt | B65D 50/046 |
| 2021/0107709 | A1 * | 4/2021 | Garcia Alberola | B65D 41/34 |

FOREIGN PATENT DOCUMENTS

| | | |
|---|---|---|
| JP | 2019-055816 | 4/2019 |
| WO | WO2019/175740 | 9/2019 |

* cited by examiner

CLOSURE WITH PIVOTAL CAP

CROSS-REFERENCE TO RELATED PATENT APPLICATION

The present application claims the benefit of and priority to U.S. Provisional Application No. 63/501,056, filed on May 9, 2023, which is incorporated herein by reference in its entirety.

BACKGROUND OF THE INVENTION

The present disclosure relates generally to the field of closures for containers. The present disclosure relates specifically to a closure for a container, the closure including a base and a cap pivotally coupled to the base via a hinge. The base includes a projection that interfaces with the cap, such as when the cap is in the closed position with respect to the base.

SUMMARY OF THE INVENTION

One embodiment of the invention relates to a closure including a first axis, a cap centered on the first axis, a hinge extending from and coupled to a rear portion of the cap, and a base centered on the first axis. The cap includes a first cylindrical wall extending downward from the top panel, the first cylindrical wall centered on the first axis, and a first projection extending radially inward from the first cylindrical wall towards the first axis. The base includes a second cylindrical wall centered on the first axis, the second cylindrical wall pivotally coupled to the first cylindrical wall via the hinge, the cap pivoting with respect to the base via the hinge between an open position and a closed position. The base further includes a securing element extending from the second cylindrical wall, the securing element configured to couple the second cylindrical wall to a container neck of a container. The base further includes a panel extending radially away from the first axis, the panel defining an upper portion of the storage compartment the closure is coupled to, the panel defining an upper surface and an outer surface facing radially away from the first axis. The base further includes a second projection coupled to a front portion of the base opposite the hinge. The second projection extends above the panel and radially further from the first axis than the panel. The second projection interfaces with the first projection of the cap when the cap is in the closed position with respect to the base.

In various embodiments, the second projection defines a second upper surface and a second outer surface facing radially away from the first axis. The second upper surface interfaces with the first cylindrical wall when the cap is actuating from the open position to the closed position and a second axis of the cap is not aligned with a third axis of the base.

In various embodiments, the interface between the projection and the first cylindrical wall biases the second axis of the cap to be aligned with the third axis of the base.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
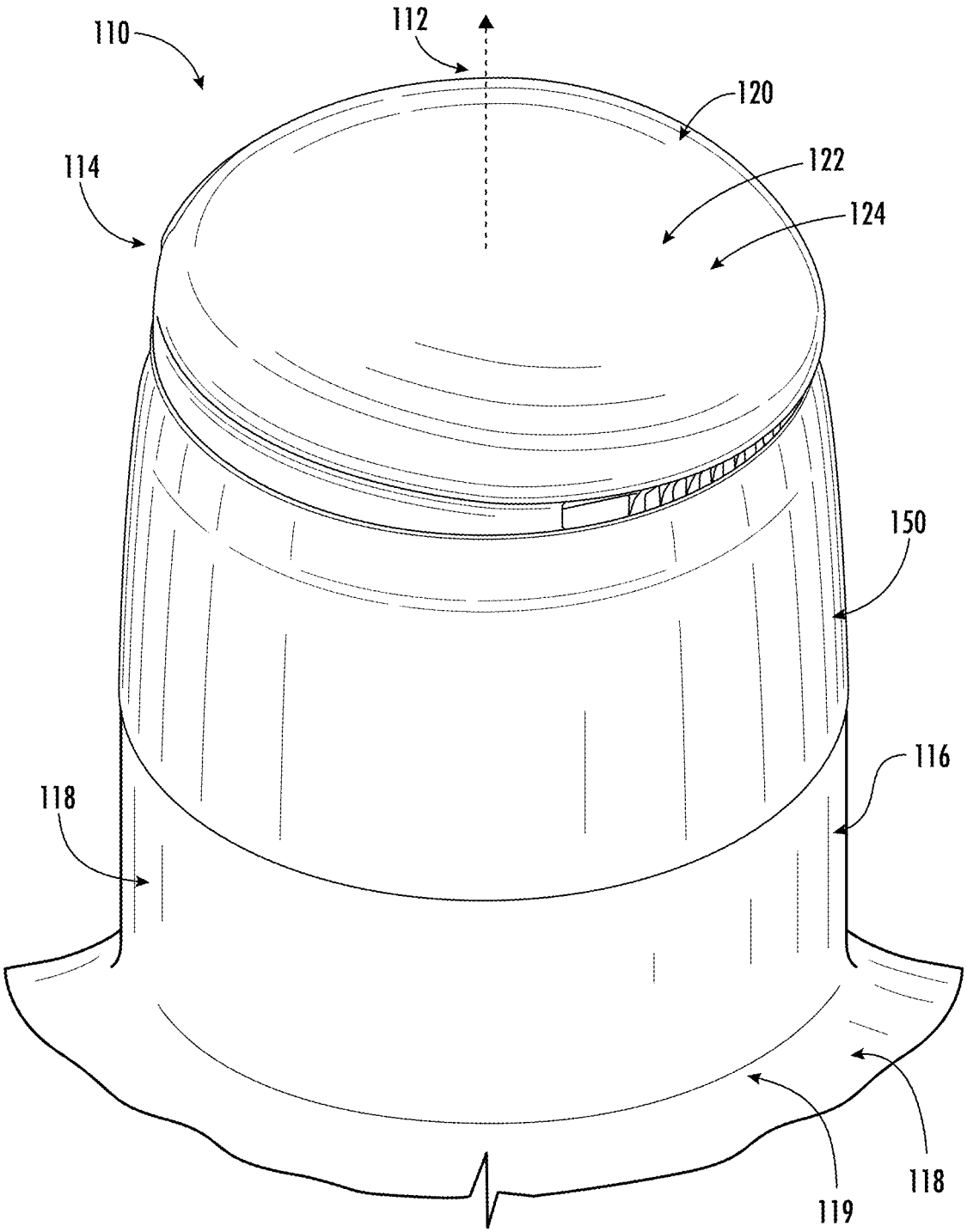
FIG. 1 is a perspective view of a closure in the closed position, according to an exemplary embodiment.

Referring generally to the figures, various aspects of a closure are shown. Closures are used to enclose storage compartments of containers, such as bottles for drinkable liquids. Many closures include a base that couples to a container neck of a container, and a cap that is pivotally coupled to the base, such as via a hinge. The base includes a panel that encloses an upper portion of the storage area of the container. A projection is coupled to a front of the panel and extends upward parallel to an axis of the closure and radially away from the axis further than the panel. Applicant has observed that the projection facilitates locking the cap and the base together compared to closures without the projection, and that the projection facilitates centering the front of the cap to the front of the base, thereby helping the user close the cap and base more easily.

Referring to FIGS. 1-4, a closure 110 for closing a container 190 according to an embodiment is shown. Closure 110 includes axis 112, and cap 120 and base 150 pivotally coupled together via hinge 114. In various embodiments, hinge 114 is extending from and coupled to a rear portion 140 of cap 120 opposite front portion 142.

Figure 2:
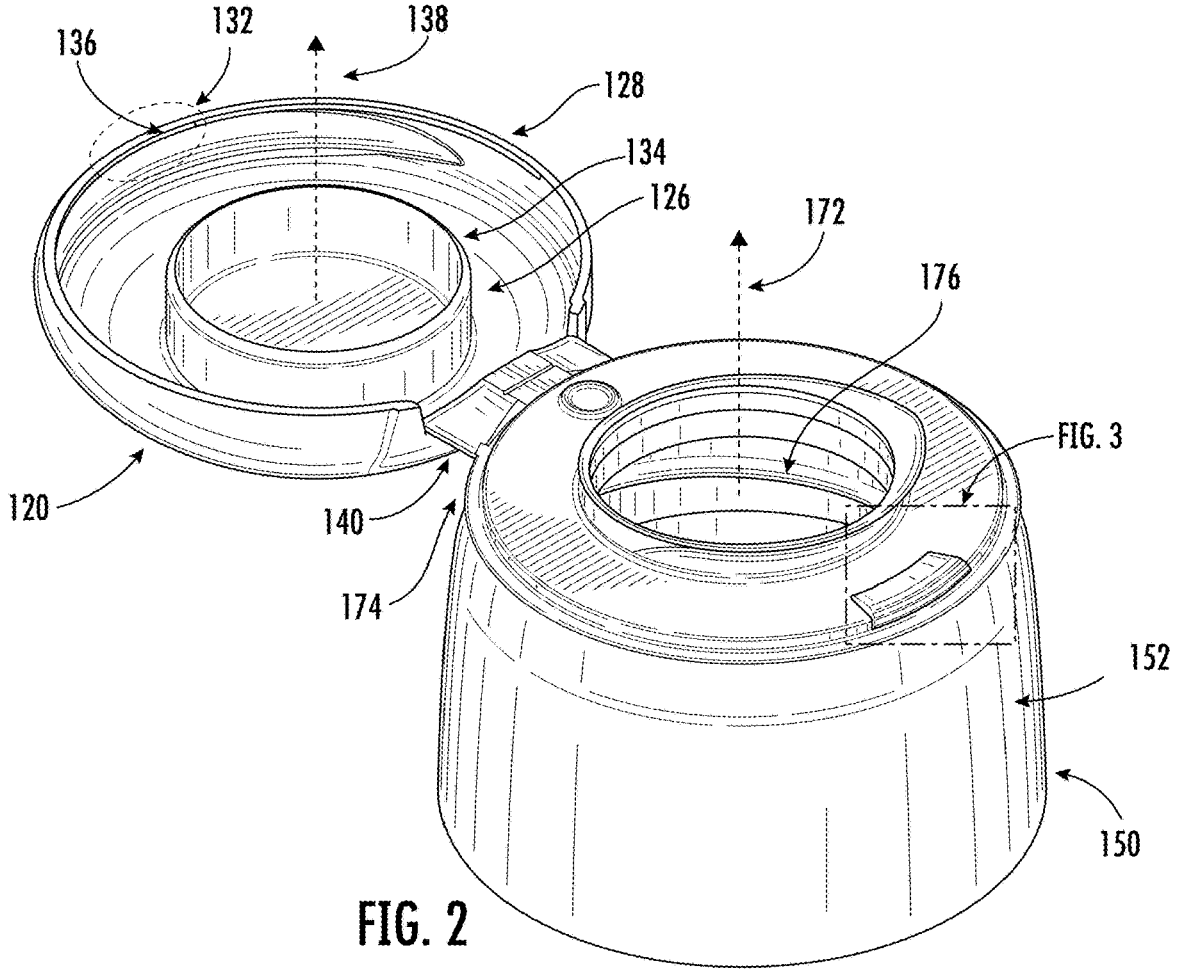
FIG. 2 is a perspective view of the closure of FIG. 1 in the open position, according to an exemplary embodiment.

In various embodiments, cap 120 and base 150 are centered on axis 112. Cap 120 is centered on axis 138, and base 150 is centered on axis 172. When cap 120 is closed relative to base 150, axis 138 and axis 172 are aligned (FIG. 1). When cap 120 is opened relative to base 150, axis 138 and axis 172 are not aligned (FIG. 2).

Cap 120 includes top panel 122, which in various embodiments is centered on axis 112 and/or axis 138. Top panel 122 includes upper surface 124 and an opposing lower surface 126. Cap 120 includes cylindrical wall 128 extending downward from top panel 122, cylindrical wall 128 centered on axis 112 and/or axis 138. Cap 120 includes front portion 132 opposite hinge 114. Cap 120 includes plug 134, extending downwardly from top panel 122 when cap 120 is in the closed position. Cap projection 136 extends radially inward from cylindrical wall 128 toward axis 112 and/or axis 138, such as from a bottom of cylindrical wall 128 opposite top panel 122.

Figure 3:
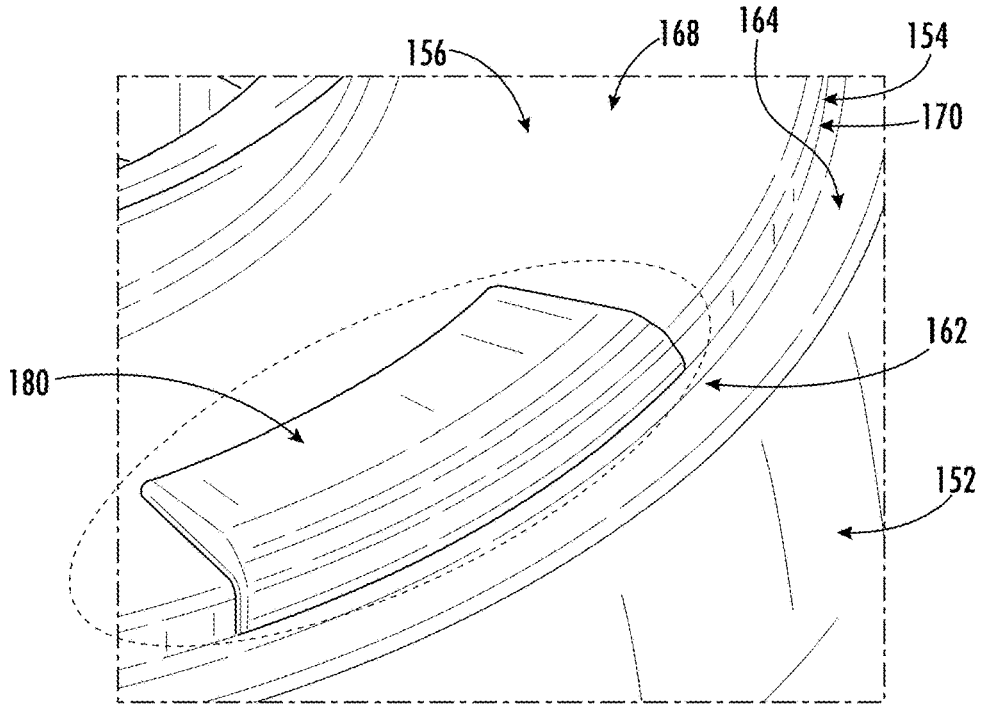
FIG. 3 is a detailed perspective view of the closure of FIG. 2 in the open position, according to an exemplary embodiment.
Figure 4:
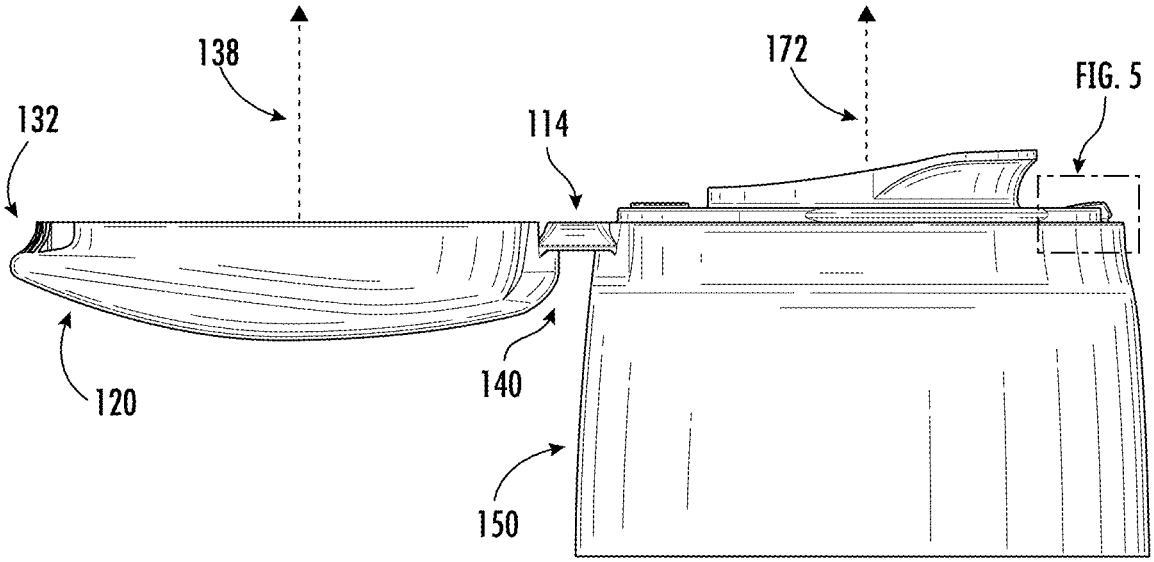
FIG. 4 is a side view of the closure of FIG. 1 in the open position, according to an exemplary embodiment.
Figure 5:
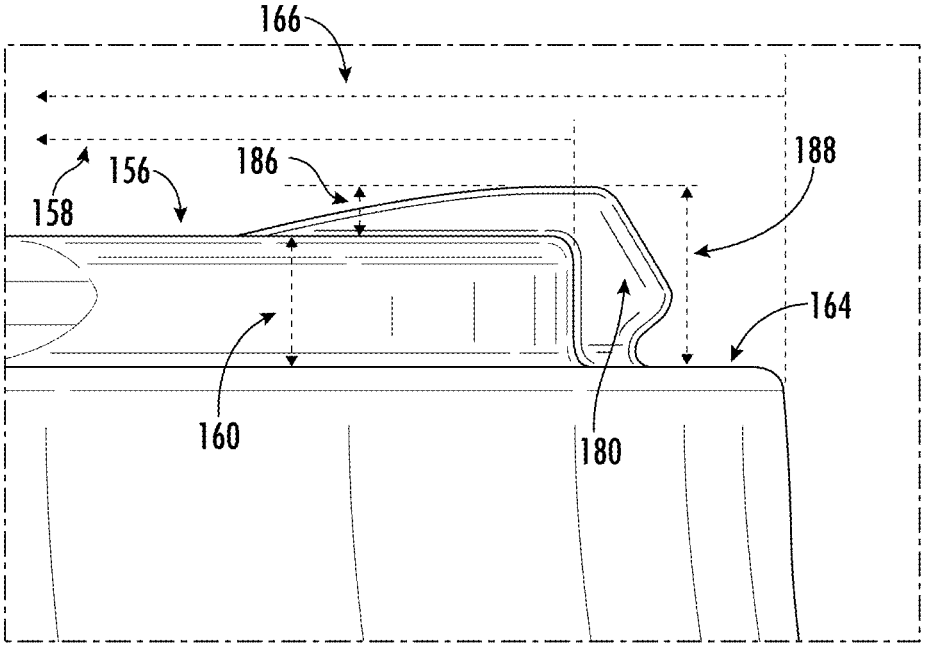
FIG. 5 is a detailed side view of the closure of FIG. 4 in the open position, according to an exemplary embodiment.
Figure 6:
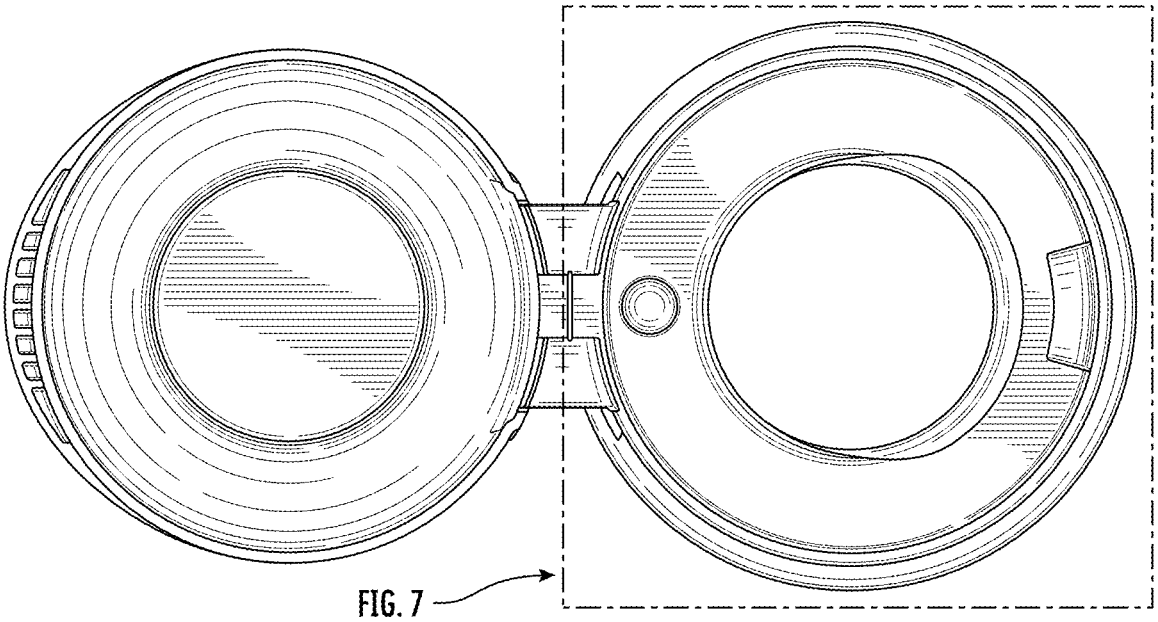
FIG. 6 is a top view of the closure of FIG. 1 in the open position, according to an exemplary embodiment.
Figure 7:
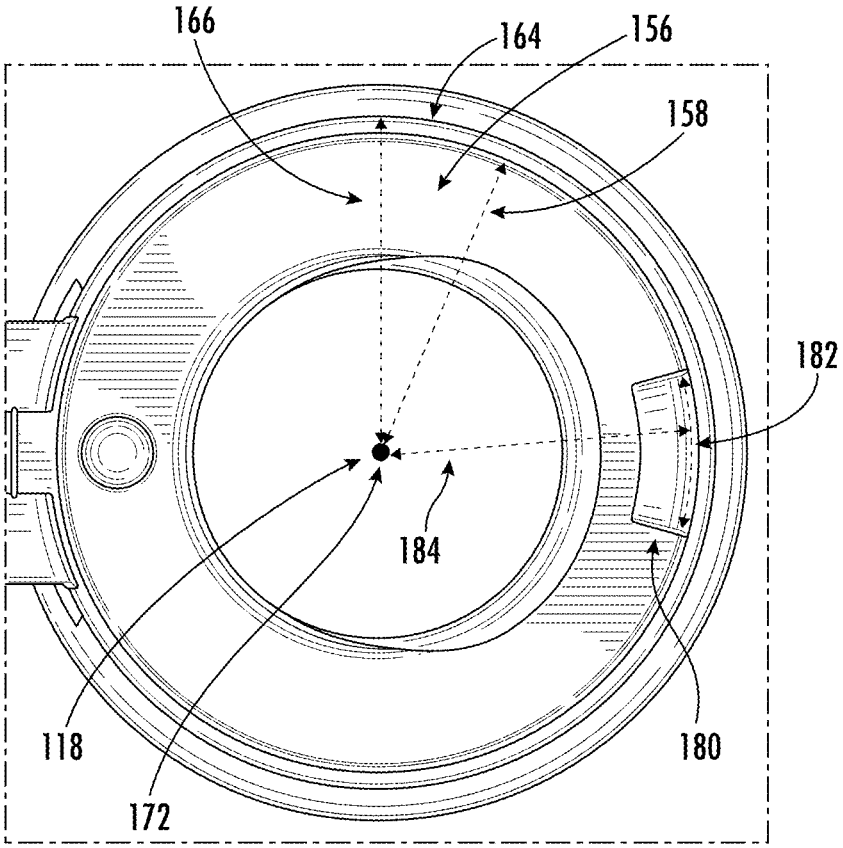
FIG. 7 is a detailed top view of the closure of FIG. 2 in the open position, according to an exemplary embodiment.

Referring to FIG. 3, base 150 includes cylindrical wall 152 and cylindrical wall 154, which in various embodiments are centered on axis 112 and/or axis 172. Cylindrical wall 152 and/or cylindrical wall 154 are pivotally coupled to cylindrical wall 128 via hinge 114, the cap 120 pivoting with respect to the base 150 via the hinge 114 between an open position and a closed position.

Base 150 includes a securing element, shown as threading 176, extending from cylindrical wall 152 towards the first axis 112. Threading 176 is configured to couple the cylindrical wall 152 to a container neck 116 of a container 118, thereby securing the contents of container 118 in storage compartment 119 of container 118.

Panel 156 extends radially inward from cylindrical wall 154 towards axis 112 and/or axis 172. Panel 156 defines an upper portion 117 of the storage compartment 119 of the container 118 the closure 110 is coupled to. Panel 156 defines an upper surface 168 facing upward and an outer surface 170, the outer surface 170 facing radially away from axis 112 and/or axis 172. Panel 164 extends radially between cylindrical wall 152 and cylindrical wall 154.

Base projection 180 is coupled to and extends from a front portion 162 of panel 156 opposite hinge 114 and rear portion 174 of base 150. Base projection 180 extends above panel 156 (e.g., above upper surface 168), the base projection 180 interfacing with cap 120 (e.g., cap projection 136) when cap 120 is in the closed position with respect to the base 150.

In various embodiments, cap 120 includes cap projection 136 extending towards the first axis 112 radially inward from cylindrical wall 128 at a front portion 132 of cap 120 opposite rear portion 140 of the cap 120. Cap projection 136 interfaces with base projection 180 when the cap 120 is in the closed position with respect to the base 150.

Referring to FIGS. 4-8, base projection 180 extends height 186 above panel 156 and height 188 above panel 164. Base projection 180 circumferentially extends circumferential distance 182 with respect to axis 112 and/or axis 172, and base projection 180 extends radius 184 from axis 112 and/or axis 172. In various embodiments, base projection 180 extends radially outward away from the axis 112 and/or axis 172 at least as far as outer surface 170 of panel 156.

In various embodiments, base projection 180 extends circumferentially around axis 112 and/or axis 172. In particular, base projection 180 extends circumferentially around axis 112 and/or axis 172 between 10 and 50 degrees, and more specifically between 20 and 40 degrees, and more specifically between 25 and 35 degrees, and more specifically 30 degrees. In particular, base projection 180 extends circumferentially around axis 112 and/or axis 172 at least 10 degrees, and more specifically at least 15 degrees, and more specifically at least 20 degrees, and more specifically at least 25 degrees, and more specifically at least 30 degrees.

In particular, base projection 180 extends circumferentially around axis 112 and/or axis 172 at most 60 degrees, and more specifically at most 50 degrees, and more specifically at most 45 degrees, and more specifically at most 40 degrees, and more specifically at most 35 degrees, and more specifically at most 30 degrees.

Panel 164 and cylindrical wall 152 extend radius 166 from axis 112 and/or axis 172. Panel 156 and cylindrical wall 154 extend radius 158 from axis 112 and/or axis 172. Panel 156 and cylindrical wall 154 extend height 160 above panel 164.

Figure 8:
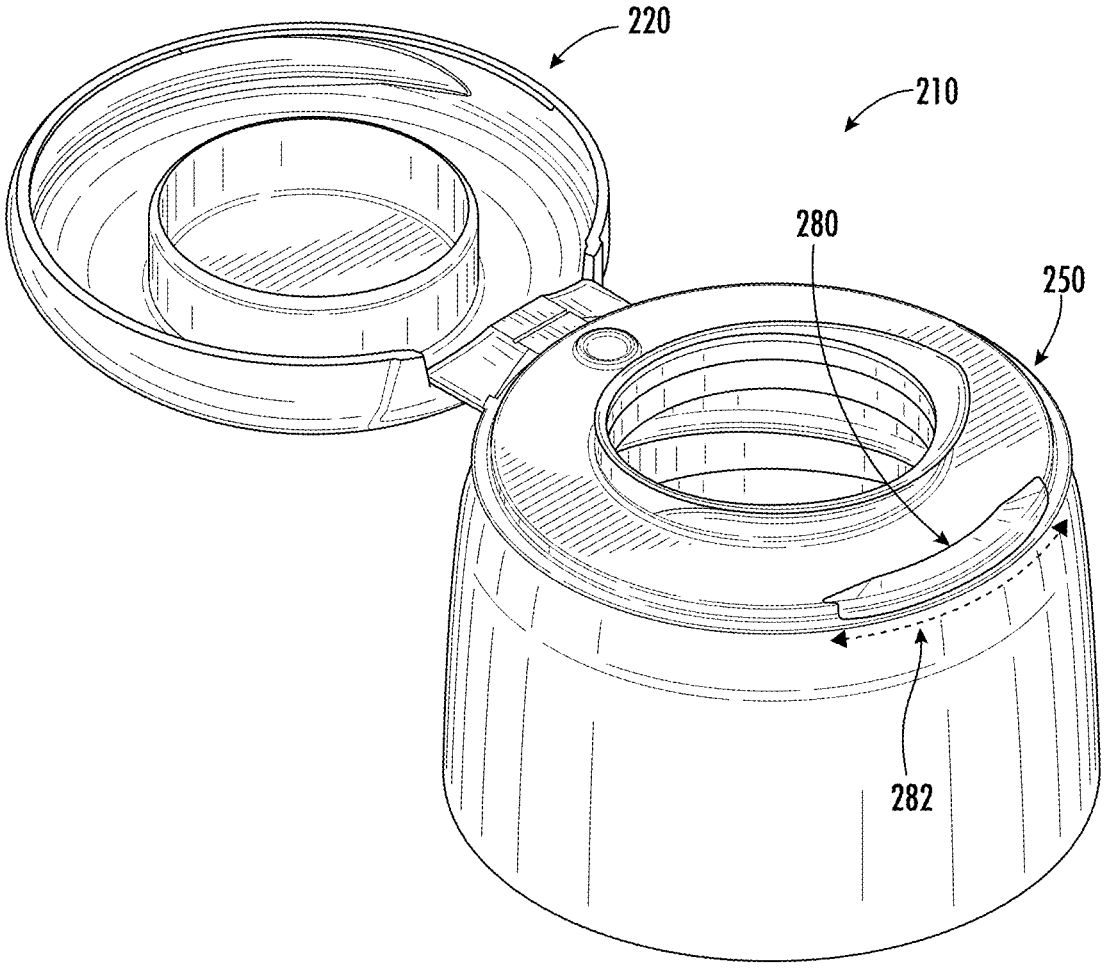
FIG. 8 is a perspective view of a second closure, according to another exemplary embodiment.

Referring to FIG. 8, closure 210 is shown according to an exemplary embodiment. Closure 210 is substantially the same as closure 110 except for the differences discussed herein. In particular, projection 280 extends a different circumferential width 282 compared to base projection 180 of closure 110. Closure 210 includes cap 220 pivotally coupled to base 250.

Figure 9:
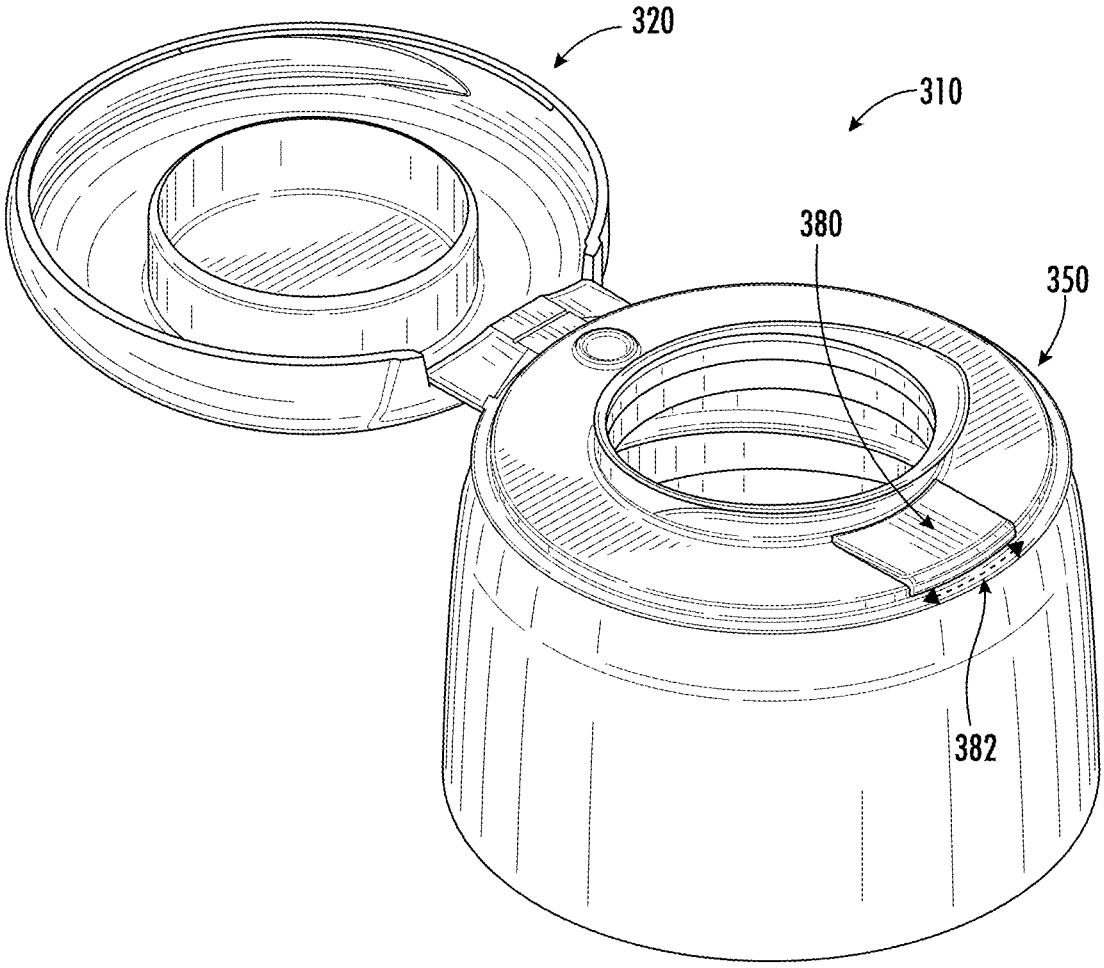
FIG. 9 is a perspective view of a second closure, according to another exemplary embodiment.

Referring to FIG. 9, closure 310 is shown according to an exemplary embodiment. Closure 310 is substantially the same as closure 110 or closure 210 except for the differences discussed herein. In particular, projection 380 extends a different circumferential width 382 compared to base projection 180 of closure 110. Closure 310 includes cap 320 pivotally coupled to base 350.

Figure 10:
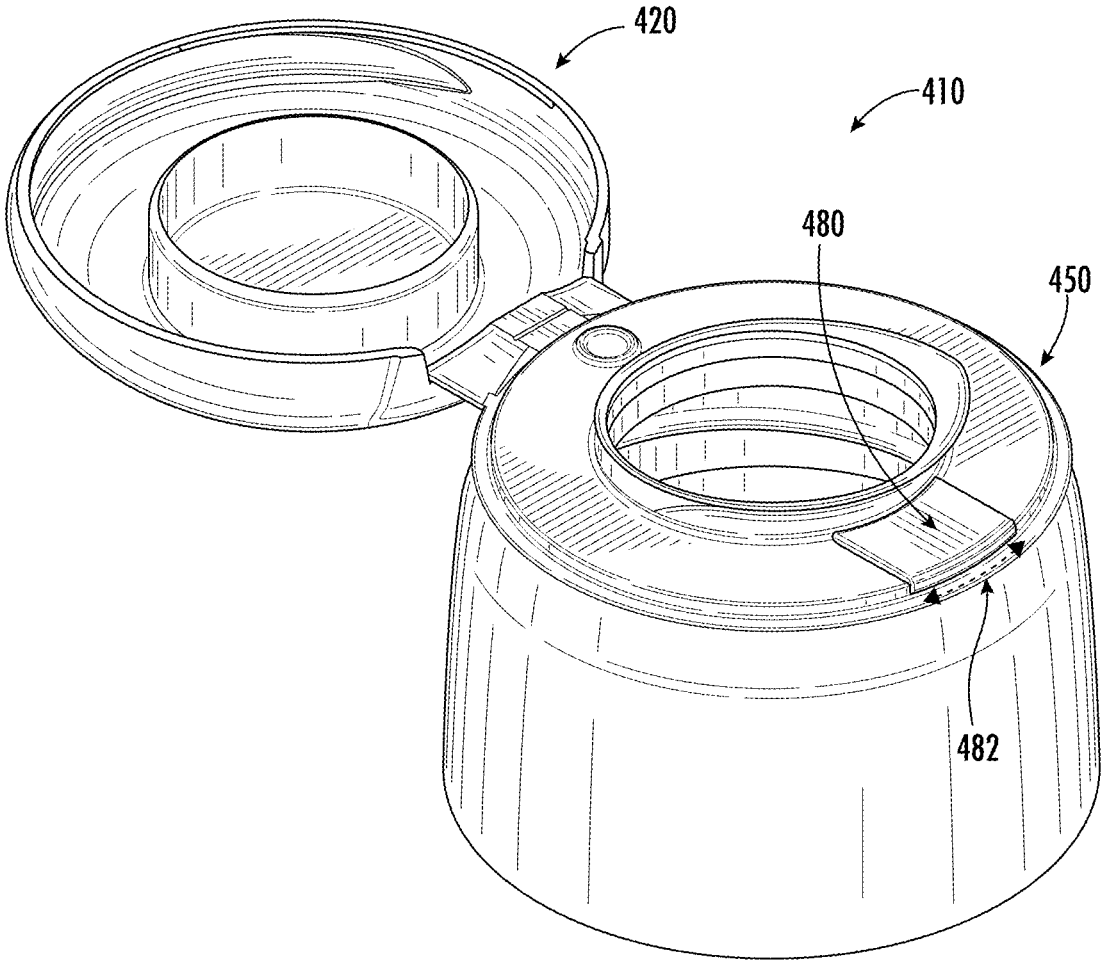
FIG. 10 is a perspective view of a second closure, according to another exemplary embodiment.

Referring to FIG. 10, closure 410 is shown according to an exemplary embodiment. Closure 410 is substantially the same as closure 110, closure 210, or closure 310 except for the differences discussed herein. In particular, projection 480 extends a different circumferential width 482 compared to base projection 180 of closure 110. Closure 410 includes cap 420 pivotally coupled to base 450.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A closure comprising:

a first axis;

a cap centered on the first axis, the cap comprising a top panel and a first cylindrical wall extending downward from the top panel, the first cylindrical wall centered on the first axis;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface facing upward and an outer surface facing radially away from the first axis; and a base projection coupled to a front portion of the base opposite the hinge, the base projection extending above the panel, the base projection interfacing with the cap when the cap is in the closed position with respect to the base, wherein the base projection extends circumferentially around the first axis between 10 degrees and 50 degrees with respect to the first axis.

2. The closure of claim 1, the cap comprising a cap projection extending towards the first axis radially inward from the first cylindrical wall at a front portion of the cap opposite the rear portion of the cap, wherein the cap projection interfaces with the base projection when the cap is in the closed position with respect to the base.

3. The closure of claim 2, the base projection extending radially outward away from the first axis at least as far as the outer surface of the panel.

4. The closure of claim 2, wherein the base projection extends circumferentially around the first axis at most 45 degrees with respect to the first axis.

5. The closure of claim 2, wherein the base projection extends circumferentially around the first axis between 20 degrees and 40 degrees with respect to the first axis.

6. The closure of claim 2, wherein the base projection extends circumferentially around the first axis at least 20 degrees with respect to the first axis.

7. The closure of claim 2, wherein the base projection extends circumferentially around the first axis at most 35 degrees with respect to the first axis.

8. A closure comprising:

a first axis;

a cap centered on the first axis, the cap comprising a top panel and a first cylindrical wall extending downward from the top panel, the first cylindrical wall centered on the first axis;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface facing upward and an outer surface facing radially away from the first axis; and a base projection coupled to a front portion of the base opposite the hinge, the base projection extending above the panel, the base projection interfacing with the cap when the cap is in the closed position with respect to the base, wherein the base projection extends circumferentially around the first axis at least 20 degrees with respect to the first axis.

9. A closure comprising:

a first axis;

a cap centered on the first axis, the cap comprising a top panel and a first cylindrical wall extending downward from the top panel, the first cylindrical wall centered on the first axis;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface facing upward and an outer surface facing radially away from the first axis; and a base projection coupled to a front portion of the base opposite the hinge, the base projection extending above the panel, the base projection interfacing with the cap when the cap is in the closed position with respect to the base, wherein the base projection extends circumferentially around the first axis at most 60 degrees with respect to the first axis.

10. A closure comprising:

a first axis;

a cap centered on the first axis, the cap comprising a top panel and a first cylindrical wall extending downward from the top panel, the first cylindrical wall centered on the first axis;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface and an outer surface facing radially away from the first axis; and a base projection coupled to a front portion of the base opposite the hinge, the base projection extending radially further from the first axis than the panel, the base projection interfacing with the cap when the cap is in the closed position with respect to the base, wherein the base projection extends circumferentially around the first axis between 10 degrees and 50 degrees with respect to the first axis.

11. The closure of claim 10, the cap comprising a cap projection extending towards the first axis radially inward from the first cylindrical wall at a front portion of the cap opposite the rear portion of the cap, wherein the cap projection interfaces with the base projection when the cap is in the closed position with respect to the base.

12. The closure of claim 11, wherein the base projection extends circumferentially around the first axis between 20 degrees and 40 degrees with respect to the first axis.

13. The closure of claim 11, wherein the base projection extends circumferentially around the first axis at most 45 degrees with respect to the first axis.

14. A closure comprising:

a first axis;

a cap centered on the first axis, the cap comprising a top panel and a first cylindrical wall extending downward from the top panel, the first cylindrical wall centered on the first axis;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface and an outer surface facing radially away from the first axis; and a base projection coupled to a front portion of the base opposite the hinge, the base projection extending radially further from the first axis than the panel, the base projection interfacing with the cap when the cap is in the closed position with respect to the base, wherein the base projection extends circumferentially around the first axis at most 60 degrees with respect to the first axis.

15. A closure comprising:

a first axis;

a cap centered on the first axis, the cap comprising:

a top panel;

a first cylindrical wall extending downward from the top panel, the first cylindrical wall centered on the first axis; and a cap projection extending radially inward from the first cylindrical wall;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface and an outer surface facing radially away from the first axis; and a base projection coupled to the hinge, the base projection extending above the panel and radially further from the first axis than the panel, the base projection interfacing with the cap projection of the cap when the cap is in the closed position with respect to the base, wherein the base projection extends circumferentially around the first axis between 20 degrees and 50 degrees with respect to the first axis.

16. The closure of claim 15, wherein the base projection is coupled to a front portion of the base opposite the hinge.

17. A closure comprising:

a first axis;

a cap centered on the first axis, the cap comprising:

a top panel;

a first cylindrical wall extending downward from the top panel, the first cylindrical wall centered on the first axis; and a cap projection extending radially inward from the first cylindrical wall;

a hinge extending from and coupled to a rear portion of the cap; and a base centered on the first axis, the base comprising:

a second cylindrical wall centered on the first axis, the second cylindrical wall pivotally coupled to the first cylindrical wall via the hinge, the cap pivoting with respect to the base via the hinge between an open position and a closed position;

a securing element extending from the second cylindrical wall towards the first axis, the securing element configured to couple the second cylindrical wall to a container neck of a container;

a panel extending radially inward towards the first axis, the panel defining an upper portion of a storage compartment of the container, the panel defining an upper surface and an outer surface facing radially away from the first axis; and a base projection coupled to the hinge, the base projection extending above the panel and radially further from the first axis than the panel, the base projection interfacing with the cap projection of the cap when the cap is in the closed position with respect to the base, wherein the base projection extends circumferentially around the first axis at most 60 degrees with respect to the first axis.

* * * * *